United States Patent [19]

Longo

[11] Patent Number: 4,468,810

[45] Date of Patent: Aug. 28, 1984

[54] CONVERTIBLE CARRYING BAG

[75] Inventor: Raffaela Longo, West Paterson, N.J.

[73] Assignee: The Mat-Pack, Inc., West Paterson, N.J.

[21] Appl. No.: 458,741

[22] Filed: Jan. 17, 1983

[51] Int. Cl.[3] ..... A45C 3/04

[52] U.S. Cl. ..... 383/3; 190/1; 5/417

[58] Field of Search ..... 190/1, 2; 5/417, 418, 5/419, 420; 150/35; 383/3

[56] References Cited

U.S. PATENT DOCUMENTS

| | | | |
|---|---|---|---|
| 2,315,126 | 3/1943 | Michalke | 5/417 |
| 3,976,113 | 8/1976 | Kim | 190/2 |
| 4,188,988 | 2/1980 | Agyagos | 190/2 |
| 4,197,891 | 4/1980 | Comollo | 5/417 |
| 4,375,111 | 3/1983 | Hall | 5/419 |

FOREIGN PATENT DOCUMENTS

| | | | |
|---|---|---|---|
| 819449 | 10/1951 | Fed. Rep. of Germany | 190/2 |
| 1264919 | 2/1972 | United Kingdom | 190/2 |

*Primary Examiner*—Steven M. Pollard
*Assistant Examiner*—David Voorhees
*Attorney, Agent, or Firm*—Samuelson & Jacob

[57] ABSTRACT

A carrying bag convertible to a flat mat includes a rectangular body member of flexible foldable material and an arrangement of fold lines and fasteners which enables the body member to be used alternately as a flat mat or a relatively compact, compartmented carrying bag, the arrangement further allowing selective joining of a plurality of such body members, when in the flat mat configuration, to establish an integral, extended flat mat assembly.

16 Claims, 8 Drawing Figures

CONVERTIBLE CARRYING BAG

The present invention relates generally to personal recreation items and pertains, more specifically, to a carrying bag which is selectively converted to a flat mat.

With the advent of stronger, lighter-weight fabrics, a number of recreation related items, such as picnic bags, beach bags and related mats have been developed in an effort to facilitate and enhance such recreational pursuits. Among these items, multipurpose assemblies have been proposed in which a carrying bag, usable as a picnic or beach bag, is selectively converted to a mat. For example, U.S. Pat. No. 4,188,988 discloses a sheet assembly for use as a multipurpose tote bag. The present invention constitutes a decided improvement over the assembly disclosed in the aforesaid patent, as well as over other currently available items sold for similar purposes. Thus, as will be explained in greater detail below, the arrangement of folds and fasteners in the present invention presents a more desirable structure when the item is in the carrying bag configuration and attains advantages as a mat when in the flat mat configuration.

It is an object of the present invention to provide a carrying bag convertible to a flat mat and wherein the arrangement of folds and fasteners is such that the fasteners are unobtrusive in both the carrying bag configuration and the flat mat configuration for maximum utility in either configuration.

Another object of the invention is to provide a convertible carrying bag of the type described and in which the arrangement of folds and fasteners establishes a multi-compartmented carrying bag.

Still another object of the invention is to provide a convertible carrying bag of the type described and in which the arrangement of folds and fasteners enables the establishment of a flat mat of maximum usable area when in the flat mat configuration.

Yet another object of the invention is to provide a convertible carrying bag of the type described and in which the arrangement of folds and fasteners enables the assembly of multiple mats, when in the flat mat configuration, for the selective establishment of a flat mat of extended dimensions.

A further object of the invention is to provide a convertible carrying bag of the type described and which has greater aesthetic appeal while enabling increased functionality.

A still further object of the invention is to provide a convertible carrying bag of the type described and which is manufactured economically of currently available materials to produce an article of increased strength and durability capable of providing a long and useful service life.

Yet a further object of the invention is to provide a convertible carrying bag of the type described and which has increased user appeal and acceptance.

The above objects, as well as still further objects and advantages, are attained by the present invention which may be described briefly as an article of manufacture convertible between a flat mat and an erect carrying bag, the article of manufacture comprising: a body member of flexible foldable material, the body member having a longitudinal centerline and an outer periphery including opposed longitudinally-extending side edges and opposed laterally-extending end edges when the body member is in a flat mat configuration; a first fold line extending laterally across the body member generally intermediate the end edges to define panels in the body member; at least one second fold line extending laterally across the body member, the second fold line being located generally intermediate the first fold line and a corresponding end edge to define a pair of main sections in the corresponding panel, such that upon folding the body member along the second fold line the main sections of the corresponding panel will be juxtaposed with one another; a pair of third fold lines extending longitudinally along the body member, each third fold line being located generally intermediate the longitudinal centerline of the body member and a corresponding side edge to define subsections in each of the panels, such that upon folding the body member along the third fold lines, subsequent to folding along the second fold line, subsections of each panel will be juxtaposed and the opposed side edges of the body member will confront one another; fastening means located along the side edges of the body member for selectively fastening together the confronting side edges subsequent to folding along the third fold lines, to establish a collapsed, generally tubular configuration in the panels, the tubular configuration having opposite ends and openings located adjacent the opposite ends such that upon folding the body member along the first fold line the panels will be juxtaposed in side-by-side receptacles extending between each opening and the first fold line; and holding means for holding the panels in that side-by-side relationship to establish the erect carrying bag.

The invention will be more fully understood, while still further objects and advantages will become apparent, in the following detailed description of a preferred embodiment illustrated in the accompanying drawing, in which.

Figure 1:
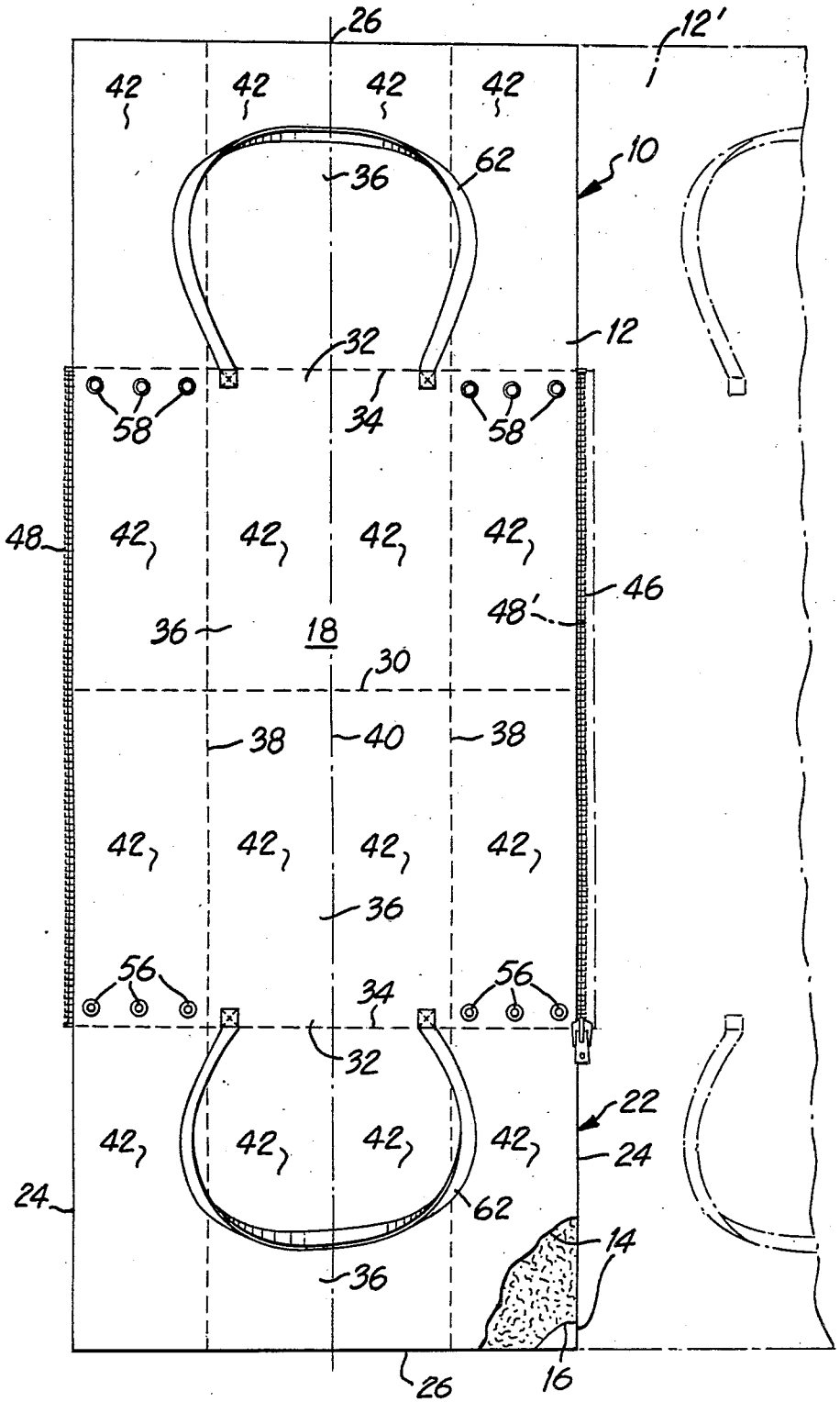
FIG. 1 is a plan view of a carrying bag constructed in accordance with the invention and arranged in flat mat configuration.
Figure 2:
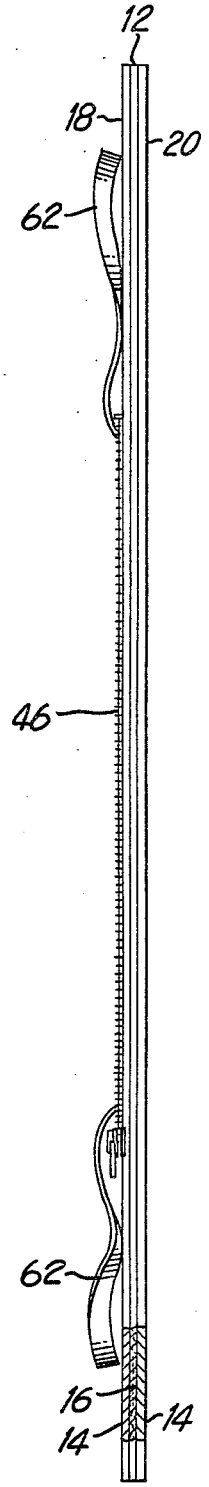
FIG. 2 is a side edge elevational view of the carrying bag in the configuration of FIG. 1.
Figure 3:
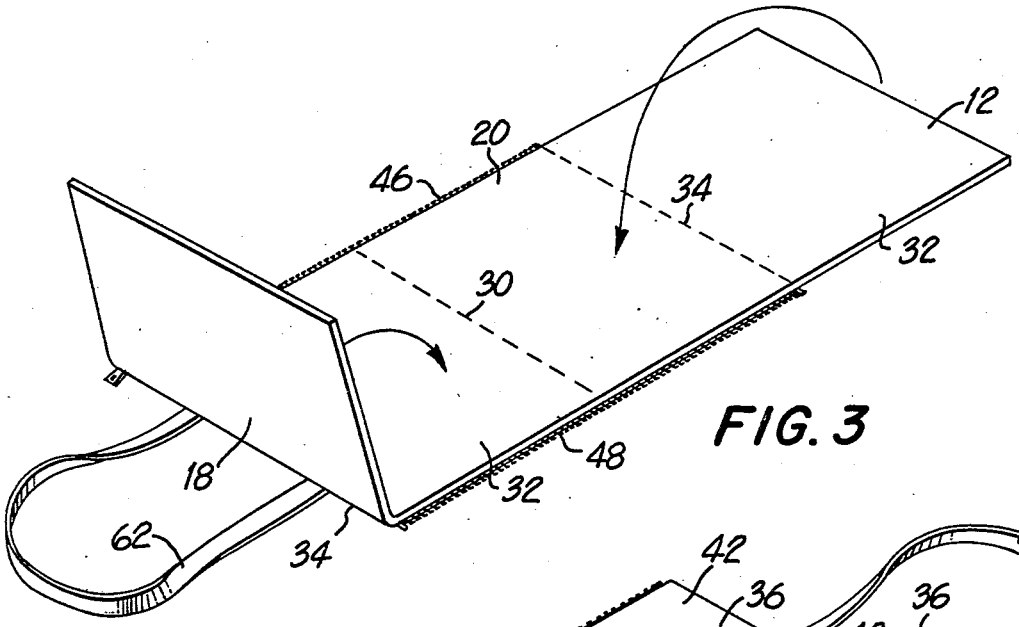
FIGS. 3 through 7 are perspective views illustrating a sequence of operations by which the carrying bag is folded from the flat mat configuration to the carrying bag configuration.

Referring now to the drawing, and especially to FIGS. 1 and 2 thereof, a carrying bag constructed in accordance with the invention is shown in a flat mat configuration in the form of a mat 10 and is seen to include a generally rectangular body member 12 of flexible foldable material. In the configuration illustrated by mat 10, the body member 12 serves as a flat mat upon which a person may sit or lie. Thus, the flexible foldable material of body member 12 may be chosen from one of a very large variety of textile materials which provide the desired comfort for the expressed use. However, currently available synthetic fibers provide materials which are especially light in weight and have strength and comfort characteristics as well as an aesthetic appearance, which render such materials especially well-suited to the present construction.

The illustrated body member 12 is constructed of an outer shell 14 of a natural fiber and synthetic resin blend, such as a cotton-polyester fabric, filled with a core 16 of softer synthetic resin material, such as a polyester fiber-fill. The resulting structure is light-weight, durable, attractive and comfortable. An outer surface 18 may be placed upon the ground while an inner surface 20 receives the person who will sit or lie on the flat mat 10 provided by body member 12. The multi-layer shell-and-core construction enables the choice of a more rugged and durable material along the outer surface 18, while the inner surface 20 may be provided by a different, perhaps softer, more absorbent material chosen for comfort.

In order to enable body member 12 to be converted from the flat mat configuration shown at mat 10 in FIGS. 1 and 2 to a carrying bag, and vice-versa, body member 12 is provided with further structural elements, arranged as follows. Body member 12 has an outer periphery 22 which includes generally parallel, longitudinally-extending opposite side edges 24 and generally parallel, laterally-extending end edges 26. Body member 12 is to be folded along predetermined lines having specified locations on the body member 12. These lines will be referred to hereinafter as "fold lines" and are illustrated as dashed lines. The fold lines may be either real or imaginary lines in the sense that the lines may be placed physically in the body member 12, as by stitching or otherwise marking the lines in the material of the body member 12, or the lines merely may express specific locations at which the body member 12 is to be folded.

Thus, a first or central fold line 30 extends laterally across the body member 12 intermediate end edges 26 and preferably is located parallel to and equidistant from end edges 26 to define two panels 32 of equal size. A pair of second fold lines 34 also extends laterally across the body member 12, each fold line 34 being located intermediate the central fold line 30 and a corresponding end edge 26, and preferably being parallel to and equidistant from the central fold line 30 and the respective end edge 26 to divide each panel 32 into a pair of main sections 36 of equal area. A pair of third fold lines 38 extends longitudinally along the body member 12, each fold line 38 being located intermediate a longitudinal centerline 40 and a corresponding side edge 24, and preferably being parallel to and equidistant from the centerline 40 and the respective side edge 24 to define equal subsections 42 in each of the main sections 36.

Figure 4:
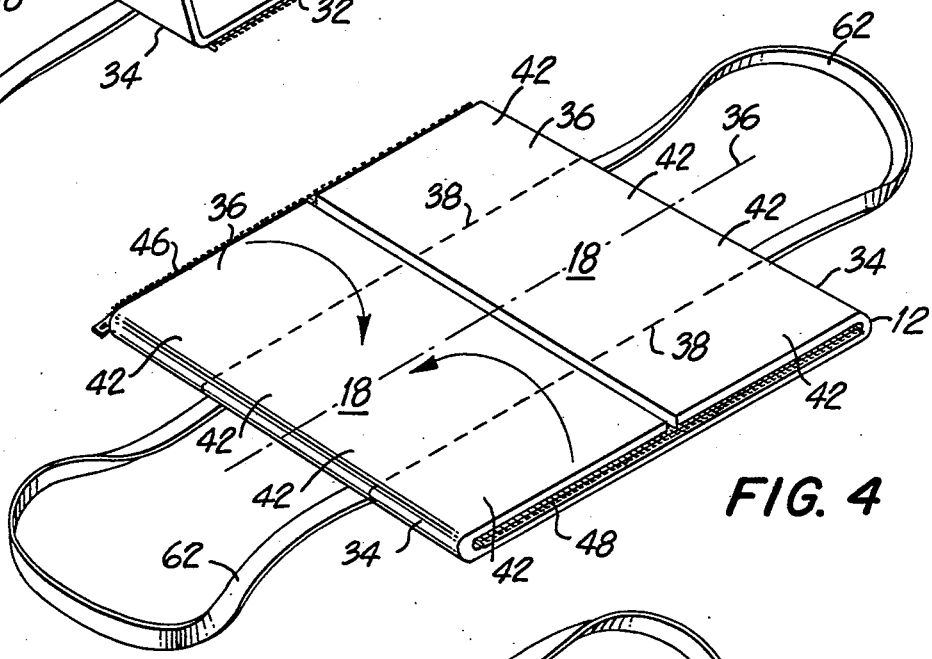
Figure 5:
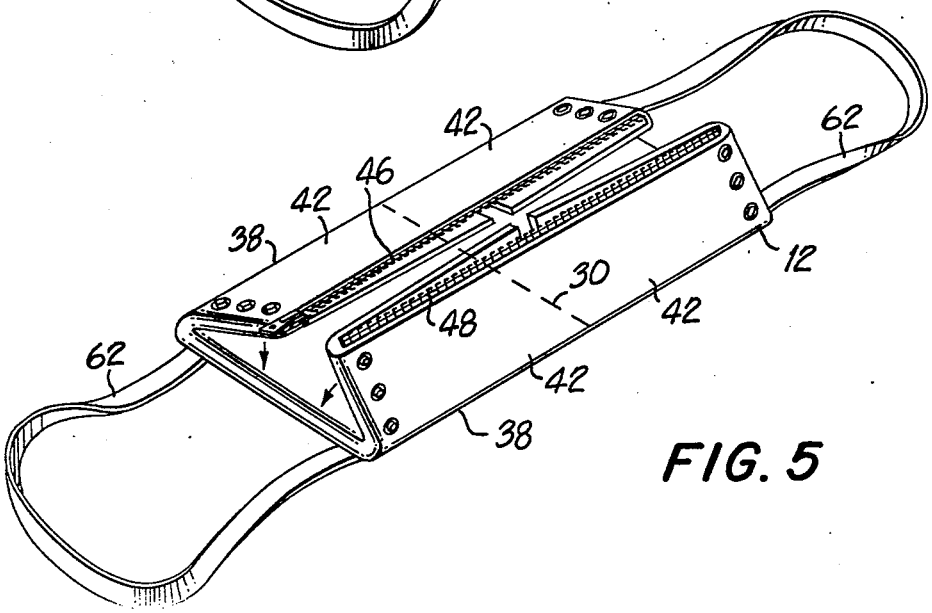
Figure 6:
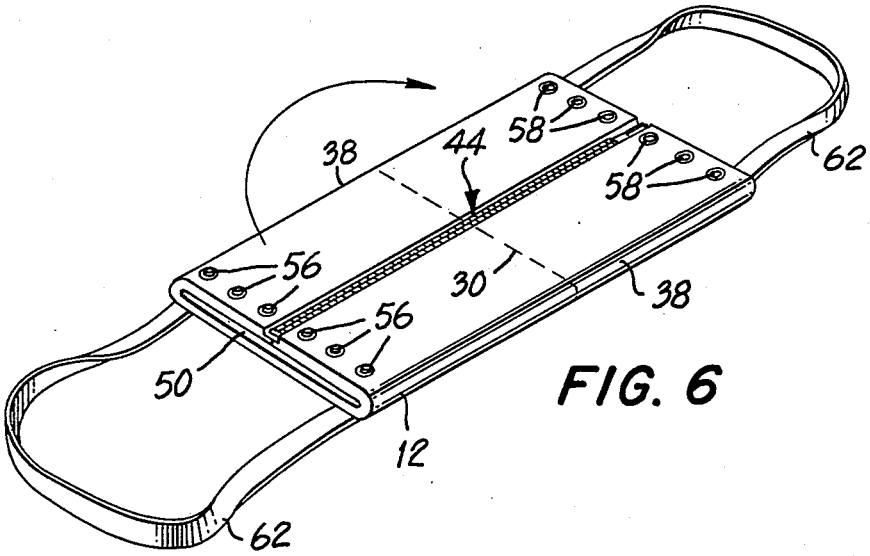
Figure 7:
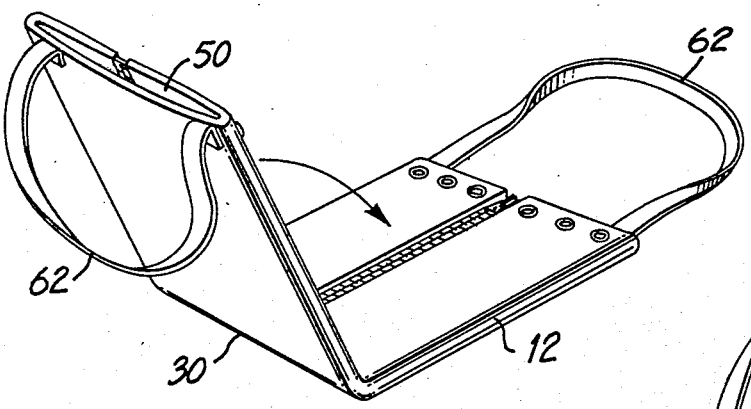

Turning now to FIGS. 3 through 8, the body member 12, when in the flat mat configuration, will rest upon the outer surface 18 and present inner surface 20 for the reception of the person who will rest upon the mat 10 provided by body member 12. Upon conversion to a carrying bag, body member 12 first will be folded along fold lines 34, as indicated by the arrows in FIG. 3, until the main sections 36 of each panel 32 are juxtaposed with one another, as seen in FIG. 4, and the opposed end edges 26 confront one another. Thus, the inner surface 20, which may be more vulnerable to damage by virtue of the preferably softer characteristic desired at surface 20, immediately is enclosed and protected by the outer surface 18. Next, the body member 12 is folded along fold lines 38, as indicated by the arrows in FIGS. 4 and 5, until subsections 42 of the main sections are juxtaposed with one another, as seen in FIG. 6, and the opposed side edges 24 confront one another.

Figure 8:
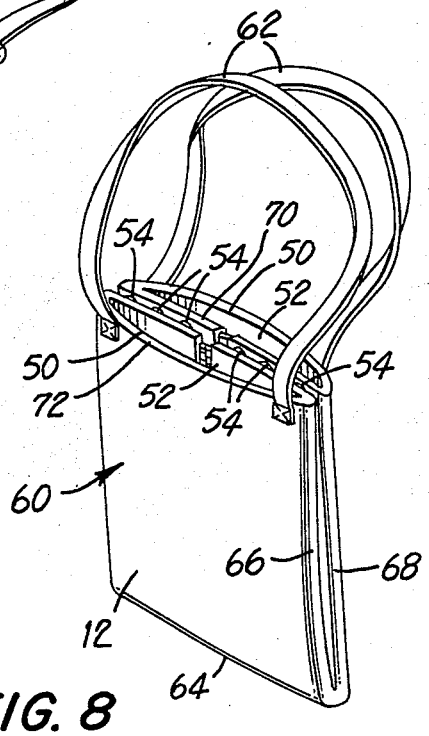
FIG. 8 is a perspective view of the carrying bag in fully erect configuration.

Fastening means is provided for fastening together the confronting side edges 24, the preferred fastening means being in the form of a slide fastener 44 having complementary slide fastener elements 46 and 48 (see FIG. 1) affixed to the body member 12 at the side edges 24 and extending therealong, preferably continuously, between the pair of fold lines 34. The slide fastener 44 is closed to establish a collapsed, generally tubular configuration in both panels 32, as seen in FIG. 6, with openings 50 located at each end of the tubular configuration, adjacent the fold lines 34. Then, the collapsed, tubular configuration is folded along fold line 30, in the direction of the arrow in FIG. 7, until the panels 32 are juxtaposed with one another, in side-by-side relationship, as seen in FIG. 8, to establish side-by-side receptacles 52 extending between each opening 50 and fold line 30.

Holding means is provided for holding together the panels 32 in the side-by-side relationship to complete the erected configuration of the carrying bag, preferred holding means being in the form of snap fasteners 54 having complementary snap fastener elements 56 and 58 affixed to the body member 12 at the outer surface 18 thereof, adjacent the fold lines 34 and adjacent the openings 50 between the side edges 24 and the corresponding fold lines 38. Upon fastening together the corresponding fastener elements 56 and 58 of each snap fastener 54, carrying bag 60 is fully erected, complete with two compartments provided by the receptacles 52.

Carrying handles 62 are affixed to the body member 12, at the outer surface 18 adjacent the fold lines 34 and openings 50, and extend longitudinally to provide convenient means for grasping the carrying bag 60. Thus, the body member 12 when in the erect configuration, provides a multi-compartmented carrying bag 60 for articles which will be used in connection with the particular recreational pursuit for which the flat mat 10 will be employed. For example, where mat 10 will be used as a beach mat, carrying bag 60 can be used for carrying towels, containers of lotion, books and other articles associated with a visit to the beach.

The location and arrangement of the fold lines and fasteners places the fasteners in unobtrusive locations when the body member 12 is in either the flat mat configuration or in the carrying bag configuration. Thus, in the flat mat configuration the slide fastener elements 46 and 48 are at the peripheral edges of the mat and do not interfere with comfortable use of the entire area of the mat. The snap fastener elements 56 and 58 are relatively small and flat and are located on the outer surface 18 of the mat so that these elements will not intrude upon the enjoyment of a smooth and uninterrupted inner surface 20, when the body member 12 is used as a mat. In the fully erect carrying bag configuration, the slide fastener 44 is well inside the boundaries of the carrying bag where the fastener cannot be opened inadvertently, thereby precluding catastrophic failure of the carrying bag. Further, the internal location of the slide fastener 44 and the snap fasteners 54 within the carrying bag 60 assures that the outer edges of the erect carrying bag will be soft, folded edges, as at folded edges 64, 66, 68, 70 and 72, seen in FIG. 8. These soft folded edges assure comfort and safety when the erect bag is being carried, as well as provide increased aesthetic appeal.

The particular location and arrangement of the slide fastener elements 46 and 48 along the outer periphery 22 of the body member 12 makes possible the selective assembly of multiple body members 12, in side-by-side assembled relationship, to establish a flat mat assembly of extended dimensions. Thus, as seen in FIG. 1, a further body member, shown in phantom at 12', identical to body member 12, may be fastened to the side edge 24 of body member 12, by virtue of the complementary slide fastener elements 46 and 48', to form an integral extended flat mat twice the size of mat 10. Such extensions may be continued indefinitely in order to expand the area to be provided with the comfort of mat 10. Where a shorter mat 10 is desired, one of the fold lines 34 may be deleted and the corresponding end edge 26 could be located where the deleted fold line 34 would have been, to delete the corresponding main section 36.

The multi-layer construction of body member 12 enables further modifications such as the selective insertion of an inflatable pillow within a panel, section or subsection, either as a permanent element or as a removable insert.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. An article of manufacture convertible between a flat mat and an erect carrying bag, said article of manufacture comprising:

a body member of flexible foldable material, the body member having a longitudinal centerline and an outer periphery including opposed longitudinally-extending side edges and opposed laterally-extending end edges when the body member is in the flat mat configuration;

a first fold line extending laterally across the body member generally intermediate the end edges to define panels in the body member;

at least one second fold line extending laterally across the body member, the second fold line being located generally intermediate the first fold line and a corresponding end edge to define a pair of main sections in the corresponding panel, such that upon folding the body member along the second fold line the main sections of the corresponding panel will be juxtaposed with one another;

a pair of third fold lines extending longitudinally along the body member, each third fold line being located generally intermediate the longitudinal centerline of the body member and a corresponding longitudinally-extending side edge to define subsections in each of said panels, such that upon folding the body member along the third fold lines, subsequent to said folding along the second fold line, subsections of each panel will be juxtaposed and the opposed side edges of the body member will confront one another;

fastening means located along said longitudinally-extending side edges of the body member for selectively fastening together the confronting longitudinally-extending side edges, subsequent to said folding along the third fold lines, to establish a collapsed, generally tubular configuration in the panels, the tubular configuration having opposite ends and openings located adjacent the opposite ends such that upon folding the body member along the first fold line the panels will be juxtaposed in side-by-side relationship and the openings will be adjacent one another to establish side-by-side receptacles extending between each opening and the first fold line; and holding means for holding the panels in said side-by-side relationship to establish the erect carrying bag.

2. The invention of claim 1 including at least a pair of second fold lines extending laterally across the body member, each second fold line being located generally intermediate the first fold line and a corresponding end edge to define a pair of main sections in each panel, such that upon folding the body member along the second fold lines the main sections of each panel will be juxtaposed with one another and upon folding the body member along the third fold lines and fastening together the confronting side edges, the openings of the tubular configuration will be located adjacent the second fold lines.

3. The invention of claim 2 including carrying handles attached to the body member and extending longitudinally therefrom adjacent the second fold lines so as to be located adjacent the openings to the receptacles in the carrying bag.

4. The invention of claim 3 wherein the holding means includes further fastening means located adjacent the second fold lines for selectively fastening together the panels in said side-by-side relationship.

5. The invention of claim 2 wherein the fastening means includes complementary fastener elements at the side edges of the body member for selective engagement with one another to establish said generally tubular configuration and for selective engagement with corresponding complementary fastener elements of further like body members when the body members are in said flat mat configuration.

6. The invention of claim 5 wherein the fastening means comprises a slide fastener and the fastener elements include complementary slide fastener elements extending continuously between the second fold lines.

7. The invention of claim 6 wherein the holding means includes further fastening means located adjacent the second fold lines for selectively fastening together the panels in said side-by-side relationship.

8. The invention of claim 7 wherein the further fastening means comprises snap fasteners having complementary snap fastener elements at the second fold lines between the side edges and the third fold lines.

9. The invention of claim 8 including carrying handles attached to the body member and extending longitudinally therefrom adjacent the second fold lines so as to be located adjacent the openings to the receptacles in the carrying bag.

10. The invention of claim 1 wherein:

the body member is generally rectangular in plan when in the flat mat configuration, with the side edges being generally parallel to one another, and the end edges being generally parallel to one another and generally perpendicular to the side edges;

the first fold line is located essentially equidistant between the end edges and is generally parallel thereto;

the second fold line is located essentially equidistant between the first fold line and a corresponding end edge and is generally parallel thereto; and each third fold line is located essentially equidistant between the centerline and a corresponding side edge and is generally parallel thereto.

11. The invention of claim 10 including at least a pair of second fold lines extending laterally across the body member, each second fold line being located essentially equidistant between the first fold line and a corresponding end edge and generally parallel thereto to define a pair of main sections in each panel, such that upon folding the body member along the second fold lines the main sections of each panel will be juxtaposed with one another and upon folding the body member along the third fold lines and fastening together the confronting side edges, the openings of the tubular configuration will be located adjacent the second fold lines.

12. The invention of claim 11 wherein the fastening means includes complementary fastener elements at the side edges of the body member for selective engagement with one another to establish said generally tubular configuration and for selective engagement with corresponding complementary fastener elements of further like body members when the body members are in said flat mat configuration.

13. The invention of claim 12 wherein the fastening means comprises a slide fastener and the fastener elements include complementary slide fastener elements extending continuously between the second fold lines.

14. The invention of claim 13 wherein the holding means includes further fastening means located adjacent the second fold lines for selectively fastening together the panels in said side-by-side relationship.

15. The invention of claim 14 wherein the further fastening means comprises snap fasteners having complementary snap fastener elements at the second fold lines between the side edges and the third fold lines.

16. The invention of claim 15 including carrying handles attached to the body member and extending longitudinally therefrom adjacent the second fold lines so as to be located adjacent the openings to the receptacles in the carrying bag.

* * * * *